United States Patent [19]

Takahashi et al.

[11] Patent Number: 4,738,631

[45] Date of Patent: Apr. 19, 1988

[54] CONNECTOR

[75] Inventors: Toru Takahashi; Naoki Manabe; Tomohisa Kaneko, all of Shizuoka, Japan

[73] Assignee: Yazaki Corporation, Japan

[21] Appl. No.: 30,387

[22] Filed: Mar. 26, 1987

[30] Foreign Application Priority Data

Mar. 27, 1986 [JP] Japan ..... 61-44037[U]
Apr. 2, 1986 [JP] Japan ..... 61-48064[U]

[51] Int. Cl.[4] ..... H01R 13/64
[52] U.S. Cl. ..... 439/248
[58] Field of Search ..... 439/246, 247, 248, 249, 439/252, 250, 251

[56] References Cited

U.S. PATENT DOCUMENTS

| | | | |
|---|---|---|---|
| 1,880,511 | 10/1932 | Soreny | 439/247 |
| 3,295,097 | 12/1966 | Van Horssen et al. | 439/246 |
| 3,699,498 | 10/1972 | Hardesty | 439/248 |
| 3,876,274 | 4/1975 | Ruehlemann et al. | 439/248 |
| 4,334,732 | 6/1982 | Roeschlein et al. | 439/248 |
| 4,351,582 | 9/1982 | Emerson et al. | 439/405 |

FOREIGN PATENT DOCUMENTS 60-8591 6/1984 Japan .

*Primary Examiner*—Gil Weidenfeld
*Assistant Examiner*—Gary F. Paumen
*Attorney, Agent, or Firm*—Wigman & Cohen

[57] ABSTRACT

A connector has at least one connector terminal which includes two electrical contacting sections connectable to partner terminals and a deformable plate connected between said electrical contacting sections and bent so as to shorten a distance between the electrical contacting sections, wherein said deformable plate sections comprises a first deformable plate portion for allowing said two electrical contacting sections to displace forward or away from each other in a first direction and a second plate portion for allowing said electrical contacting sections to displace in a second direction perpendicular to the first direction, and a set of connector housing for accommodating said electrical contacting sections therein, respectively. One of said connector housings is displaceably assembled to the other connector housing such that a deviation between the electrical contacting section and the partner terminal can be corrected by adjusting the position of the displaceable connector housing.

13 Claims, 4 Drawing Sheets

CONNECTOR

BACKGROUND OF THE INVENTION

1. Field of the Invention

This invention relates to an improvement of a connector for electrical connection, and more particularly relates to a connector comprising a connector terminal having two electrical contacting sections for mating terminals and a deformable plate connected between the electrical contacting sections and bent to a specific shape, thereby preventing occurrence of excessive local dynamic friction during the engagement of the terminals since a deviation in the positioning between the terminals can be easily adjusted, and further making it easy to have a compact design.

2. Description of the Prior Art

As a connector comprising a connector terminal which has electrical contacting sections at opposite ends thereof and has a function that can easily correct a deviation in the positioning of terminal for mating terminals, there is known a type as disclosed in Japanese Patent Publication No. 60-8591.

Said conventional connector has such constructions as described hereunder. Specifically, as shown in FIG. 1, a connector terminal 1 has at opposite ends thereof a load insertion section 2 for a printed board and a pin support section 3 provided with a pin receptacle hole 3*a*, respectively, as the electrical contacting section. Further, between the load insertion section 2 and pin support section 3, there is provided a deformable plate 4 including a vertical plate portion 4*a* that is freely deformable in the right and left directions in the drawing and a horizontal plate portions 4*b* that is freely deformable in the up and down directions in the drawing. Said pin receptacle hole 3*a* is formed as an oblong aperture extending longitudinally. A pin A of the printed board is inserted into the aperture for electrical connection so that the pin A can displace therein along the longitudinal direction of the aperture.

Thereby, a deviation of positioning of the electrical contacting sections of the terminal for the partner terminal can be easily adjusted by deforming said deformable plate in the right and left directions as well as the up and down directions, and by adjusting the inserting position of the pin A to the oblong aperture of the pin receptacle hole 3*a*.

In the conventional connector, however, there was disadvantage that it is difficult to have a compact design for the connector and connector terminal, since separation between the electrical contacting sections 2 and 3 tends to increase its total length "l" due to using the linearly disposed deformable plate 4. In addition, there was the other disadvantage that the electrical connection in the oblong aperture 3*a* is deteriorated during engagement of the terminals due to excessive local dynamic friction on the electrical contacting section occurred by the displacement of the pin A in the oblong aperture 3*a*.

SUMMARY OF THE INVENTION

The present invention has been made in view of the foregoing disadvantages.

Accordingly, it is a main object of the present invention to provide a connector which makes it difficult, in an engagement of terminals, to generate the excessive local dynamic friction in electrical contacting sections, and makes it easy to have a compact design of the connector.

It is another object of the present invention to provide a connector that if there is a deviation between terminals, it is possible to correct position and attitude of the electrical contacting sections of the connector terminal of the connector so as to conform with those of an electrical contacting section of the mating terminal with an extremely small force.

It is an other object of the present invention to provide a connector that even if vibrations are generated in the state of engagement of terminals, there will not occur unsatisfactory contact between the terminals.

In order to attain the above objects, the connector according to the present invention comprises at least one connector terminal including two electrical contacting sections connectable to mating terminals and a deformable plate connected between said electrical contacting sections and bent so as to shorten a distance between the electrical contacting sections, wherein said deformable plate comprises a first deformable plate portion for allowing said two electrical contacting sections to be displaced toward or away from each other in a first direction and a second plate portion for allowing said electrical contacting sections to be displaced in a second direction perpendicular to the first direction, and a set of connector housings for accommodating said electrical contacting sections, respectively.

The connector according to the present invention having the above structure has the following advantages. Since the electrical contacting sections are displaced in the first and second directions by means of the deformable place having such construction described above, it is easy to correct a deviation between the connector terminal and a mating terminal, thereby preventing occurence of the excessive local dynamic friction in the electrical contacting sections during insertion and withdrawal of the terminals. As a result, the connector of the present invention is suited for securing a stable state of electrical contact. Further, it is also possible to make it easy to have a compact design of size and shape of the connector, since the electrical contacting sections are connected by the deformable plate bent so as to shorten a distance between the electrical contacting sections. Furthermore, the connector of the present invention having the above advantages is manufactured with ease.

These and other objects and advantages of the present invention, as well as the details of illustrative embodiments, will be more fully understood from the following specification and drawings, in which:

DETAILED DESCRIPTION OF THE PREFERRED EMBODIMENT

Referring to the attached drawings, the constructions of the embodiments according to the present invention will be explained.

Figure 1:
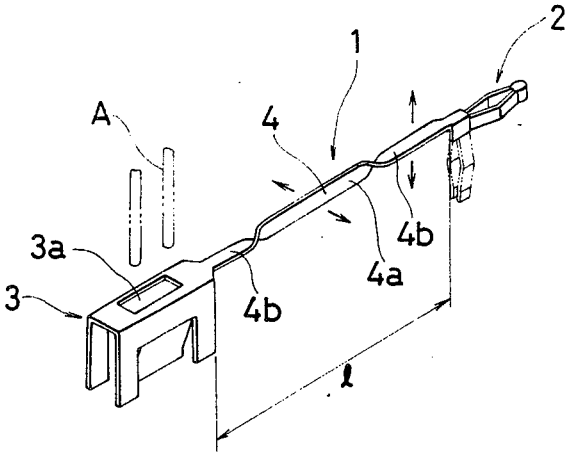
FIG. 1 (PRIOR ART)
FIG. 1 is a perspective view of the prior art connector terminal.
Figure 3:
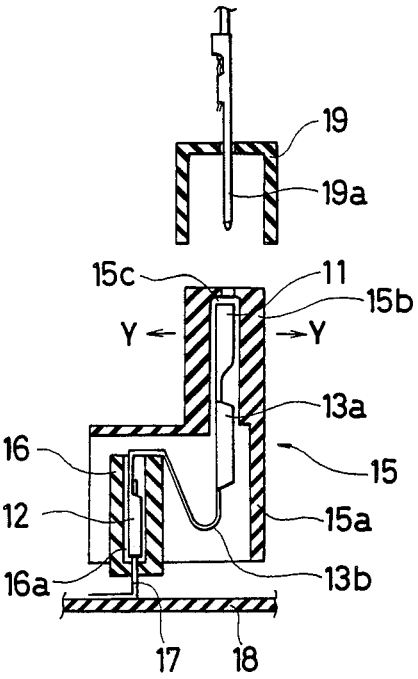
FIG. 3 is a sectional view which illustrates the connector of the first embodiment shown in FIG. 2 in actual use.
Figure 2:
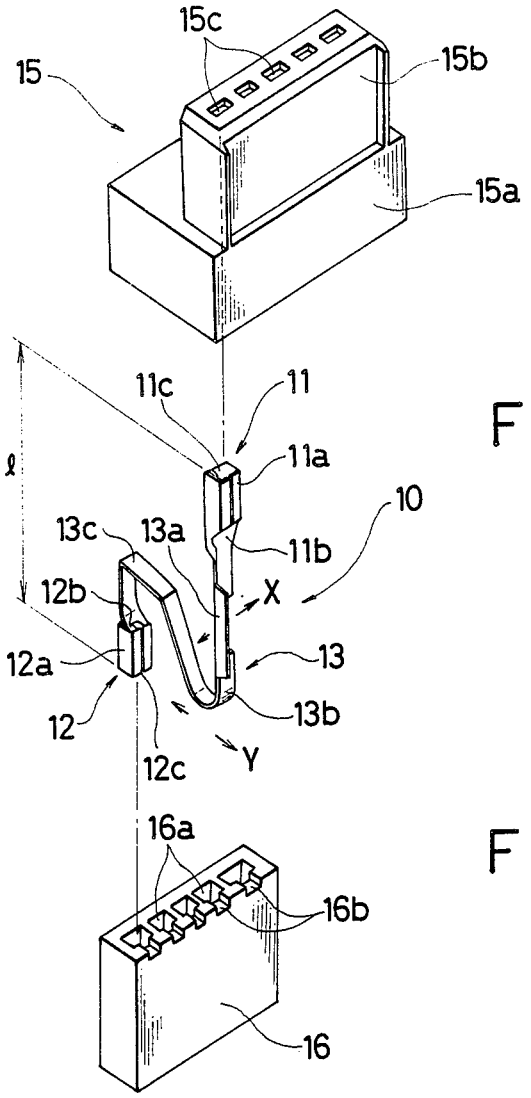
FIG. 2 is a perspective view of a connector of the first embodiment, which shows the separated state of the housings and connector terminal.

As shown in FIGS. 2 and 3, a connector of the first embodiment according to the present invention comprises a connector terminal 10 and a set of connector housings 15 and 16.

Said connector terminal 10 comprises electrical contacting portions 11 and 12 provided at the opposite ends thereof, respectively, and a deformable plate 13 connected between the electrical contacting sections 11 and 12. Said deformable plate 13 includes a vertical deformable plate portion **13*a* that is freely deformable in the left and right directions (which are indicated by the arrows "X" in FIG. 2) and an U-shaped deformable plate portion 13*b* that is freely bendable in the front and back directions (which are indicated by the arrows "Y" in FIG. 2). In other words, the U-shaped deformable plate portion 13*b* allows the two electrical contacting sections 11 and 12 to be displaced toward or away from each other in the first direction and the vertical plate portion 13*a*** allows the electrical contacting sections to be displaced in a second direction perpendicular to the first direction.

The electrical contacting sections 11 and 12 are given the so-called female terminal structure. Said female terminal structures comprises accepting sections **11*a* and 12*a* for mating tab terminals, respectively. Each accepting section is formed by bending extending portions provided on opposite sides of each base plate portion 11*b* or 12*b* inwardly so as to form a substantially box-shape, and elastic contacting pieces 11*c* or 12*c* extending from the base plate portion 11*b* or 12*b* which are folded into the inside of the accepting section 11*a* or 12*a*, at the entrance portion to the accepting section 11*a* or 12*a***.

One end of the vertical deformable plate portion **13*a* is integrally connected to the base plate portion 11*b* of the electrical contacting section 11, and the other end is integrally connected to one end of the U-shaped deformable plate portion 13*b*. The other end of the U-shaped deformable plate portion 13*b* is integrally connected to the base plate portion 12*b* of the electrical contacting section 12. In addition, on the side of the electrical contacting section 12 of the U-shaped deformable plate portion 13*b*, plate portion 13*b* is folded back to form a horizontal plate portion 13*c* such that the electrical contacting section 12 is turned to the direction opposite to that of the electrical contacting section 11**, as shown in FIGS. 2 and 3.

Reference numeral 15 shows a first connector housing. Said connector housing 15 comprises a box-shape body section **15*a* and an accommodating section 15*b* provided on the body section 15*a* at the one side thereof. The accommodating section 15*b* has a plurality of accommodating rooms 15*c* for accommodating the electrical contacting section 11 therein. Reference numeral 16 shows a second connector housing which is loosely assembled into the body section 15*a* of the first connector housing 15 as shown in FIG. 3. The second connector housing 16 also has a plurality of accommodating rooms 16*a* for accommodating the electrical contacting section 12 therein. On the surface at the opening end of each accommodating room 16*a*, there is provided a groove 16*b* for positioning the horizontal plate portion 13*c* of the connector terminal 10**.

The electrical contacting sections 11 and 12 provided on both ends of the connector terminal 10 are inserted to be attached to the accommodating rooms **15*c* and 16*a* of the housings 15 and 16, respectively, as shown in FIG. 3, and the terminal 10** is held in the rooms by means of a well-known means that is not shown.

In use, the electrical contacting section 12 in the second housing 16 is coupled with a bus bar or male terminal 17 erected in advance on a wiring board or printed board 18, thereby fixing the second housing 16 on the board 18. At this time, the first housing 15 is not fixed yet. Therefore, the housing 15 is in a state to be moved freely in the left and right directions (which are indicated by the arrows "X" in FIG. 2) with respect to the connector terminal 10 by means of the vertical deformable plate portion **13*a* that can be deformed freely in these directions. Further, the housing 15 is also in a state to be moved freely in the front and back directions (which are indicated by the arrows "Y" in FIGS. 2 and 3) with respect to the connector terminal 10 by means of the U-shaped deformable plate portion 13*b*** that can be deformed freely in the directions.

Figure 4A:
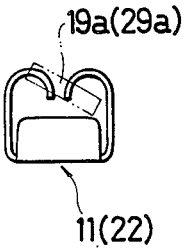
FIG. 4 (*a*) and (*b*) are diagrams for explaining displacement of the connector terminal of the connector during engagement with a mating terminal.
Figure 4B:
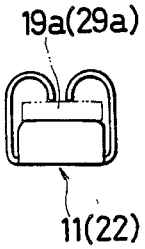

As a result, when a mating connector 19 having a male terminal **19*a* is engaged with the housing 15, since the housing 15 can be moved freely in the front and back as well as the left and right directions, the male terminal 19*a* and the female terminal (electrical contacting section 11) can be coupled in a normal state without generating mutual twisting. Accordingly, in a case where the male terminal 19*a* has a position and attitude which do not match those of the electrical contacting section 11 as shown in FIG. 4 (A), the electrical contacting section 11 can be engaged with the male terminal 19*a* by easily conforming its position and attitude to those of the partner terminal 19*a* of the connector 19**, as shown in FIG. 4 (B).

Further, since the connector terminal 10 has the U-shaped movable plate **13*b*, the total length "l" between the electrical contacting sections 11 and 12** can be relatively reduced, so that this is suited for compacting the size and shape of the connector terminal.

The connector terminal in FIG. 2 shows an exemplary example of the connector according to the present invention in which both of the electrical contacting sections 11 and 12 are assumed to be female terminals. However, one or both of them may be made male terminals. Further, the horizontal plate section **13*c* of the U-shaped deformable plate portion 13*b*** may be deleted.

The connector terminal may be formed by bending metallic sheet materials punched to a predetermined shape.

In FIGS. 5 to 8, the second embodiment of a connector according to the present invention which comprises a connector terminal 20, a fixed housing 26 and a movable housing 28, is described.

Figure 5:
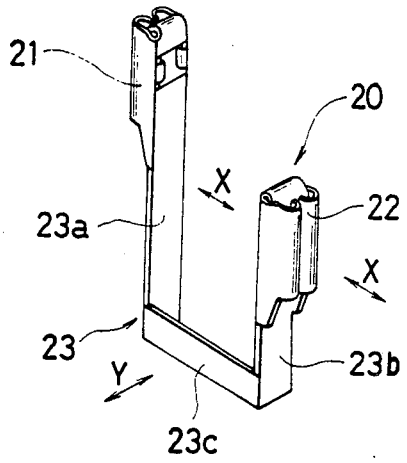
FIG. 5 is a perspective view of a connector terminal of a connector of the second embodiment.

In FIG. 5, said connector terminal 20 comprises a substantially U-shaped deformable plate 23 and electrical contacting sections 21 and 22 provided at the opposite ends of the U-shaped deformable plate 23, respectively.

Said U-shaped deformable plate comprises two longitudinal plate portions **23*a* and 23*b* each having the electrical contacting section 21 or 22 at one end thereof and one transverse deformable plate portion 23c integrally connected between the other ends of the longitudinal plate portions 23a and 23b. The surface of the transverse plate portion 23c is at a right angle to the surfaces of the longitudinal plate portions 23a and 23b. One of the longitudinal plate portions 23a is relatively longer than the other longitudinal plate portion 23b. Said longitudinal deformable plate portions 23a and 23b are freely deformable in the front and rear directions (which are indicated by the arrow "X" in FIG. 5) and the transverse deformable plate portion 23c is freely deformable in the left and right directions (which are indicated by the arrow "Y" in FIG. 5). In other words, the longitudinal plate portions 23a and 23b allow the electrical contacting sections 21 and 22 to be displaced toward or away from each other in the first direction and the transverse plate portion 23c allows the electrical contacting sections 23a and 23b** to be displaced in a second direction perpendicular to the first direction.

Said electrical contacting sections 21 and 22 are also given the so-called female terminal structure such as the electrical contacting sections 11 and 12 of the first embodiment.

The connector terminal may be formed by bending metallic sheet materials punched to a predetermined shape.

Figure 6:
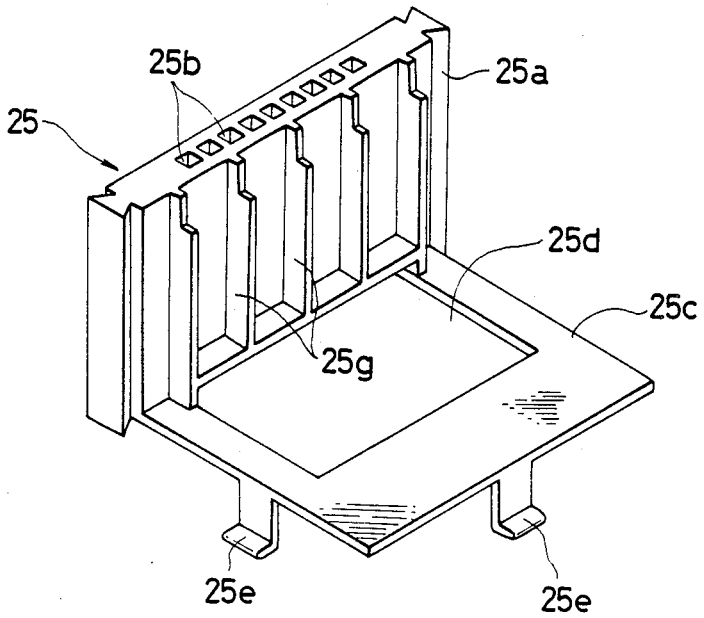
FIG. 6 is a perspective view of a fixed housing of the connector.
Figure 7:
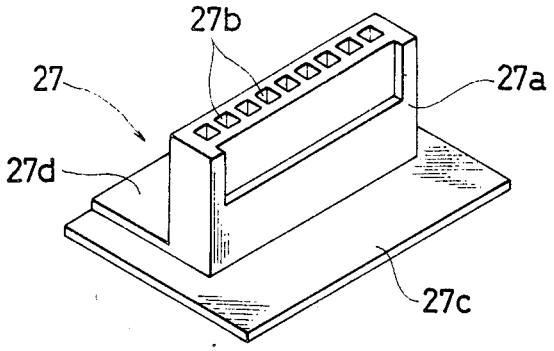
FIG. 7 is a perspective view of a movable housing of the connector.
Figure 8:
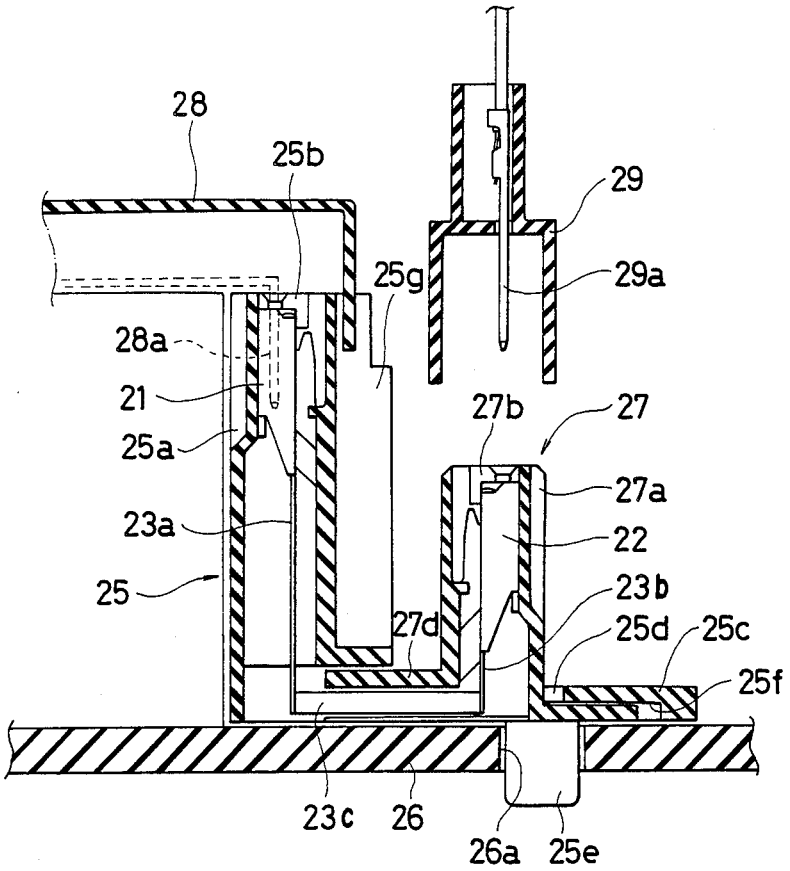
FIG. 8 is a sectional view which illustrates the connector of the second embodiment in actual use.

A fixed housing 25 comprises, as shown in FIG. 6, an accommodating room section 25a having a plurality of accommodating rooms 25b to which the electrical contacting section 21 of the connector terminal 20 is accommodated and a substantially U-shaped pressing board 25c having a rectangular space 25d in its center and connected to the lower portion of the accommodating room section 25a. At three positions on the bottom surface of the pressing board 25c, there are provided fixing legs 25e for fixing the fixed housing 25 to a body of a connecting box 26 by inserting them to holes 26a drilled in the connecting box 26, respectively, as shown in FIG. 8. Further, the lower surface of the pressing board 25c has a depression 25f which creates a space between the upper surface of the connecting box 26 and the lower surface of the pressing board 25c. Furthermore, on the one side of the lateral surface of the accommodating room section 25a, there are provided a plurality of partition walls 25g.

A movable housing 27 comprises an accommodating room section 27a having a plurality of accommodating rooms 27b to which the electrical contacting section 22 is accommodated a pressing board section 27c which is integrally provided on the lower part of the accommodating room section 27a and a stepped board section 27d provide on the pressing board section 27c on the one side of the accommodating room section 27a.

Said movable housing 27 is assembled to the fixed housing 25 in a condition that the pressing board 27c is slidably inserted into the space defined by the depression 25f in the fixed housing 25 and the accommodating room section 27a is protruded upwardly through the rectangular space 25d of the pressing board 25c. Further, the connector terminal 20 is also assembled to the assembled housings 25 and 27 in a condition that the electrical contacting sections 21 and 22 are accommodated in the accommodating rooms 25b and 27b, respectively, as shown in FIG. 8. In this case, the rectangular space 25d is given a sufficiently large size compared with the accommodating room section 27a. Therefore, the movable housing 27 is allowed to be displaced within the rectangular space 25d toward the "X" and "Y" directions.

Reference numerals 28 and 29 are housings of male terminals 28a and 29a which are inserted into the electrical contacting section 21 accommodated in the fixed housing 25 and the electrical contacting section 22 in the movable housing 27, respectively.

In the connector described above, the electrical contacting section 22 linked with the electrical contacting section 21 that is in an engaged state with the male terminal 28a accommodated in the housing 28 can be displaced so as to conform with the male terminal 29a accommodated in the housing 29 by adjusting the position of the movable housing 28. In this case, since the electrical contacting section 22 is linked with the electrical contacting section 21 though the U-shaped deformable plate which is freely deformable in the directions "X" and "Y" in FIG. 5, it is easy for the movable housing to be displaced in these directions. As a result, in a case where the male terminal 29a is inserted to the electrical contacting section 22 with a position and attitude of the male terminal 29a which do not match those of the electrical contacting section 22 as shown in FIG. 4 (A), the electrical contacting section 22 can be engaged with the male terminal 29a by easily conforming its position and attitude to those of the electrical contacting section 22, as shown in FIG. 4 (B).

In addition, since the connector 20 uses the U-shaped deformable plate 23, a distance between the electrical connecting sections 21 and 22 becomes short in comparison with the prior art connector terminal, so that compacting the size of the connector can be attained.

Furthermore, even if vibrations are generated by external force in either one after engagement of male terminal 29a with the electrical contacting section 22 is established, there will not be generated an unsatisfactory contact between them since the position and attitude of the electrical contacting section 22 can be easily conformed to those of the male terminal 29a by means of the U-shaped deformable plate.

In the embodiment in the foregoing, description has been given in conjunction with a connector that has female terminals on its both ends. However, in the same manner as the first embodiment, the connector of the present invention is not limited to the female terminals, and can also be applied to the case of male terminals.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A connector comprising;

at least one connector terminal including two electrical contacting means connectable to mating terminals and a deformable plate means connected between said electrical contacting means and bent so as to shorten a distance between the electrical contacting means, wherein said deformable plate means comprises a first deformable plate portion for allowing said two electrical contacting means to be displaced toward or away from each other in a first direction and a second plate portion for allowing said electrical contacting means to be displaced in a second direction perpendicular to the first direction; and a set of connector housings for accommodating said electrical contacting means, respectively;

wherein said connector housings have at least one accommodating room for accommodating said electrical contacting means, respectively, and said connector housings are loosely assembled to each other such that one of the connector housings can be freely displaced relative to the other connector housing;

wherein said deformable plate means has a U-shaped configuration formed from two longitudinal deformable plate portions comprising the first deformable plate portion and a traverse deformable plate portion as the second deformable plate portion connected perpendicularly to and between the longitudinal plate portions.

2. A connector as set forth in claim 1, wherein said electrical contacting means are female terminals.

3. A connector as set forth in claim 1, wherein said electrical contacting means are male terminals.

4. A connector as set forth in claim 1, wherein one of said electrical contacting means is a female terminal and the other is a male terminal.

5. A connector as set forth in claim 1, wherein said connector housings comprise a fixed housing having at least one accommodating room for accommodating one of the electrical contacting means of the connector terminal and a movable housing having at least one accommodating room for accommodating the other electrical contacting means, and said movable housing is displaceably assembled to the fixed housing, whereby the movable housing can be freely displaced to the fixed housing fixed on a printed board to confirm position and attitude of the electrical contacting means accommodated therein with those of the partner terminal easily.

6. A connector comprising:

at least one connector terminal having two electrical contacting means connectable to mating terminals, respectively, and a deformable plate connected between said electrical contacting means and bent so as to shorten a distance between the electrical contacting means, wherein said deformable plate comprises a substantially U-shaped deformable plate portion for allowing said two electrical contacting means to be displaced toward or away from each other in a first plane and a vertical deformable plate portion for allowing said electrical contacting means to be displaced in a second plane perpendicular to the first plane, said vertical deformable plate portion extending perpendicularly to the plane of the material from which said U-shaped deformable plate portion is formed; and a set of connector housings each having at least one accommodating room for accommodating one of said electrical contacting means therein, and said connector housings being loosely assembled to each other in such a manner that one of the connector housings can be freely displaced relative to the other connector housing.

7. A connector as set forth in claim 6, wherein said U-shaped deformable plate portion has two ends, with one end thereof connected to one of the electrical contacting means, and said vertical deformable plate portion being disposed between the other end of the U-shaped deformable plate portion and the other electrical contacting means.

8. A connector as set forth in claim 7, wherein said U-shaped deformable plate portion is folded back at a side where said one electrical contacting means is provided in such a manner that the electrical contacting means provided thereon is turned to an opposite direction to that of said other electrical contacting means.

9. A connector as set forth in claim 6, wherein said electrical contacting means are female terminals.

10. A connector as set forth in claim 6, wherein said electrical contacting means are male terminals.

11. A connector as set forth in claim 6, wherein one of said electrical contacting means is a female terminal and the other is a male terminal.

12. A connector as set forth in claim 7, wherein said housings comprise a first connector housing having at least one accommodating room for accommodating the electrical contacting means provided to the vertical deformable plate portion and a second connector housing having at least one accommodating room for accommodating the electrical contacting means provided to the U-shaped deformable plate portion, and said first connector housing is displaceably assembled to the second connector housing, whereby the first connector housing can be freely displaced with respect to the second connector housing fixed on a said mating terminal provided on a printed circuit board to conform the position and attitude of the electrical contacting means accommodated in said first connector housing with those of another said mating terminal.

13. A connector as set forth in claim 8, wherein said U-shaped deformable plate portion is formed by bending a flat-belt-shaped metal strip, and said vertical deformable plate portion is also formed from a flat-belt-shaped metal strip.

* * * * *

UNITED STATES PATENT AND TRADEMARK OFFICE

CERTIFICATE OF CORRECTION

PATENT NO. : 4,738,631

DATED : April 19, 1988

INVENTOR(S) : TORU TAKAHASHI et al

It is certified that error appears in the above-identified patent and that said Letters Patent is hereby corrected as shown below:

IN THE SPECIFICATION:

Column 5, line 50, after "accommodated" insert --,--.

IN THE CLAIMS:

Claim 1, column 7, line 13, "traverse" should be --transverse--;

line 14, "as" should be --comprising--.

Signed and Sealed this

Twenty-seventh Day of September, 1988

*Attest:*

DONALD J. QUIGG

*Attesting Officer*

*Commissioner of Patents and Trademarks*